US010893732B2

(12) United States Patent
Hevier et al.

(10) Patent No.: US 10,893,732 B2
(45) Date of Patent: Jan. 19, 2021

(54) BOOK ENCLOSURE FOR THE STORAGE, TRANSPORT AND DISPLAY OF DECORATIVE PINS

(71) Applicants: Alexander Harrison Hevier, Winter Garden, FL (US); Sydney Paige Hevier, Winter Garden, FL (US); Julia Eliese Hevier, Winter Garden, FL (US); Ronald John Hevier, Jr., Winter Garden, FL (US); Rochelle Lynn Hevier, Winter Garden, FL (US)

(72) Inventors: Alexander Harrison Hevier, Winter Garden, FL (US); Sydney Paige Hevier, Winter Garden, FL (US); Julia Eliese Hevier, Winter Garden, FL (US); Ronald John Hevier, Jr., Winter Garden, FL (US); Rochelle Lynn Hevier, Winter Garden, FL (US)

( * ) Notice: Subject to any disclaimer, the term of this patent is extended or adjusted under 35 U.S.C. 154(b) by 0 days.

(21) Appl. No.: 16/550,226

(22) Filed: Aug. 24, 2019

(65) Prior Publication Data

US 2019/0380462 A1 Dec. 19, 2019

Related U.S. Application Data

(63) Continuation of application No. 15/600,237, filed on May 19, 2017, now abandoned.

(51) Int. Cl.
*A45C 11/24* (2006.01)
*A45C 3/02* (2006.01)
(Continued)

(52) U.S. Cl.
CPC ..... *A45C 11/24* (2013.01); *A45C 3/02* (2013.01); *A45C 11/16* (2013.01); *A45C 13/02* (2013.01);
(Continued)

(58) Field of Classification Search
CPC ..... A45C 3/02; A45C 11/00; A45C 11/04; A45C 11/16; A45C 11/24; A45C 13/02;
(Continued)

(56) References Cited

U.S. PATENT DOCUMENTS 3,280,972 A * 10/1966 Thomas ..... A47G 1/12 206/495
3,997,050 A * 12/1976 Patterson ..... A45C 11/16 206/566

(Continued)

*Primary Examiner* — Bryon P Gehman
(74) *Attorney, Agent, or Firm* — Chad D. Tillman; Jeremy C. Doerre; Tillman Wright, PLLC

(57) ABSTRACT

A book enclosure for the storage, transport and display of decorative pins. The book has page (s) that open for the viewing, securing, protecting and safe transportation of decorative pins in which the page surface is comprised of a puncturable and resilient material for the piercing through and repositioning of the post (s) portion of a decorative pin(s) and defining a mounting surface for decorative pins. Between the page (s) there is a protective page to prevent decorative pins from contact and potential damage. A translucent front with a zipper allows for the display and viewing of decorative pins. A zipper closure allows for the secure closure to protect pins from falling out. The book has a removable strap for shoulder or cross-body portage or to hang for display. The back of the book has a pouch enclosure for the storage of pin backs.

19 Claims, 12 Drawing Sheets

(51) Int. Cl.

| | |
|---|---|
| ***A45C 11/16*** | (2006.01) |
| ***A45C 13/02*** | (2006.01) |
| ***A45C 13/30*** | (2006.01) |
| ***G09F 5/02*** | (2006.01) |
| ***G09F 1/00*** | (2006.01) |
| *B44C 5/02* | (2006.01) |
| *A47G 5/02* | (2006.01) |

(52) U.S. Cl.
CPC ..... *A45C 13/30* (2013.01); *G09F 1/00* (2013.01); *G09F 5/02* (2013.01); *A47G 5/02* (2013.01); *B44C 5/02* (2013.01)

(58) Field of Classification Search
CPC ..... A45C 13/10; A45C 13/18; A45C 13/20; A45C 13/30; A45C 1/08; A45C 3/00; A45C 3/04; A45C 3/06; A47G 5/02; B44C 5/02; G09F 1/00; G09F 5/02
USPC ..... 206/6.1, 472–476, 496; 150/100–130; 190/116
See application file for complete search history.

(56) References Cited

U.S. PATENT DOCUMENTS

| | | | | |
|---|---|---|---|---|
| 4,465,179 | A | 8/1984 | Miller | |
| 4,720,012 | A * | 1/1988 | Dufour | A45C 11/16 206/472 |
| 4,787,516 | A | 11/1988 | Morrison | |
| 4,810,102 | A | 3/1989 | Norton | |
| 4,848,562 | A | 7/1989 | Liu | |
| 4,907,704 | A * | 3/1990 | Souders | A45C 11/16 211/85.2 |
| 4,923,069 | A * | 5/1990 | Germain | A45C 11/16 206/495 |
| 4,958,727 | A | 9/1990 | Bergeron | |
| 5,025,918 | A | 6/1991 | Bergeron | |
| 5,419,063 | A | 5/1995 | Lane | |
| 5,452,806 | A * | 9/1995 | Campas | A47F 5/0006 206/495 |
| 5,617,948 | A | 4/1997 | Rainey | |
| 7,731,023 | B1 | 6/2010 | Lesch | |
| 7,740,131 | B2 * | 6/2010 | Marcello | A45C 11/00 206/473 |
| 9,826,817 | B2 * | 11/2017 | Whitehill | A45C 3/00 |
| 2006/0180481 | A1 * | 8/2006 | McGaughey, Sr. | A47F 7/03 206/6.1 |
| 2008/0060951 | A1 | 3/2008 | Pantelis et al. | |
| 2009/0294499 | A1 * | 12/2009 | McKinney | B43K 23/001 224/576 |
| 2016/0007719 | A1 * | 1/2016 | Harstvedt | A45F 3/04 224/645 |

* cited by examiner

BOOK ENCLOSURE FOR THE STORAGE, TRANSPORT AND DISPLAY OF DECORATIVE PINS

CROSS-REFERENCE TO RELATED APPLICATIONS

The present application is a continuation of Ser. No. 15/600,237, which published as U.S. Patent Appl. Publication No. 2018/0332938 A1, incorporated by reference herein.

STATEMENT REGARDING FEDERALLY SPONSORED RESEARCH OR DEVELOPMENT

This application is not subject to any federally sponsored research or development.

REFERENCE TO SEQUENCE LISTING, TABLE, OR COMPUTER PROGRAM LISTING

There is no sequence listing, table, or computer program listing for this application.

BACKGROUND OF THE INVENTION

Field of the Invention

The present invention relates to a display book enclosure for the storage, transportation and display of decorative pins.

Description of the Related Art

Decorative pins, also known as service pins, metal badges, brooches, or lapel pins, have a long history originating in the military signifying the wearer's membership in a particular branch of the service or participation in a particular theatre of operation. Later, service pins were issued by businesses wishing to award employees and commemorate the number of years employed. Fraternal organizations such as the Lion's Club, The Rotary Club, and Masonic lodges often use membership pins to designate a wearer's affiliation. More recently, collectable pins becoming very popular with comics and movies such as Star Wars, Harry Potter, and other science fiction/fantasy genres. Collectible and decorative trading pins are descendants of the service pins and are presently used to commemorate or celebrate sporting events such as the Olympics, sports team affiliations, media creations such as those of Walt Disney, participation in charitable events, and other special awards, associations or affiliations. Many decorative lapel pins are colorful, highly elaborate and festive creations that are infrequently worn due to the difficulty and cost of obtaining a replacement and are often displayed; if at all, in a matted frame or shadowbox that generally has space for numerous pins.

As the collections of pins have grown, so has the need and the desire to trade pins with other collectors to complete a particular collection. Pin trading has become the most popular event in many conventions for groups collecting pins. Pin traders use lanyards to showcase and transport pin collections. Lanyards do not hold the pins well, and pins fall out and get damaged or lost. Other pin books also require pin backs to secure pins in place, causing the user to exert much effort removing the pin back before trading. What is needed is a way to showcase the collection of the individual lapel pins for showing and trading, while protecting the pins from damage resulting from contact with other pins, staining and other damage that may occur as a result of falling off lanyards or other types of pin books that do not hold pins securely.

BRIEF SUMMARY OF THE INVENTION

The instant invention is a holder resembling, in some ways, a book, having a front, face, a back, and an interior space for the retention and display of decorative pins. The pages of the book are comprised of a material which the decorative pins are puncturable and are self-healing so that the posts of various decorative pins may be repeatedly pierced through the insert and the insert remain supportive of the decorative pin post(s) time after time. While preferably, the raised portion is a ridge defining a rectangular border encompassing an area within, the raised border may be a round, polygon, ellipse, or other shape. Puncturable pages defining a mounting surface for the decorative pins are pierced by the post part of a decorative pin. One preferred embodiment, according to the instant invention, includes an enclosure with 2 or more pages that can be securely shut through the use of a zipper. Within said embodiment would be where the front of the book enclosure would have a translucent repositionable, protective material which would allow the user to display decorative pins while secured in the book. The inside of the enclosure has pages defining a surface to receive the posts of the decorative pins, Typically, a puncturable page resides inside the enclosure and at least partially conforms to the interior shape of the enclosure. While preferably the viewing opening on the front cover has a clear material, it is possible that a clear cover may be attached to the opening as a window after the insertion of the puncturable insert with decorative pin. Self-healing deformable insert can be made of material such as natural or synthetic rubber, ethylene vinyl acetate, corrugated plastic or other such material that can accommodate multiple piercings so that the decorative pins can be changed frequently without affecting the insert's usability.

One objective of the present invention is to provide a storage and display enclosure for a lapel, service, or other decorative pin having posts, one surface being the front which is encased in a translucent material such that the pins stored are visible while the case is securely shut. Another objective of the present invention is to provide a puncturable mounting surface for a lapel, service, or other decorative pin or similar jewelry item having posts. Yet another objective of the present invention is to provide a puncturable mounting surface for decorative pins that can be re-used. Yet another objective of the present invention is to provide a puncturable insert with a decorative surface treatment that serves as an attractive background for the mounting and display of decorative pins. Still another objective of the present invention is to an ornamental enclosure that can be rested upon a flat surface or hung on a wall or other surface for the containment and display of a lapel, service, or other decorative pin or similar jewelry item having posts.

DESCRIPTION OF THE DRAWINGS

For a more complete understanding of the present invention, reference is now made to the following descriptions.

REFERENCE NUMERALS IN THE DRAWINGS

For a more complete understanding of the present invention parts, reference is now made to the following descriptions:

1—Translucent cover of the front page
2—Back of the book enclosure
3—Pouch
4—Interior pages
5—Protective page
6—Front Page
7—Zipper
8—Decorative pins
9—Holes in the star pattern
10—External partitions
11—The middle partition
12—The zipper of the translucent cover of he front page
13—Hooks
14—The removable strap

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

Figure 1:
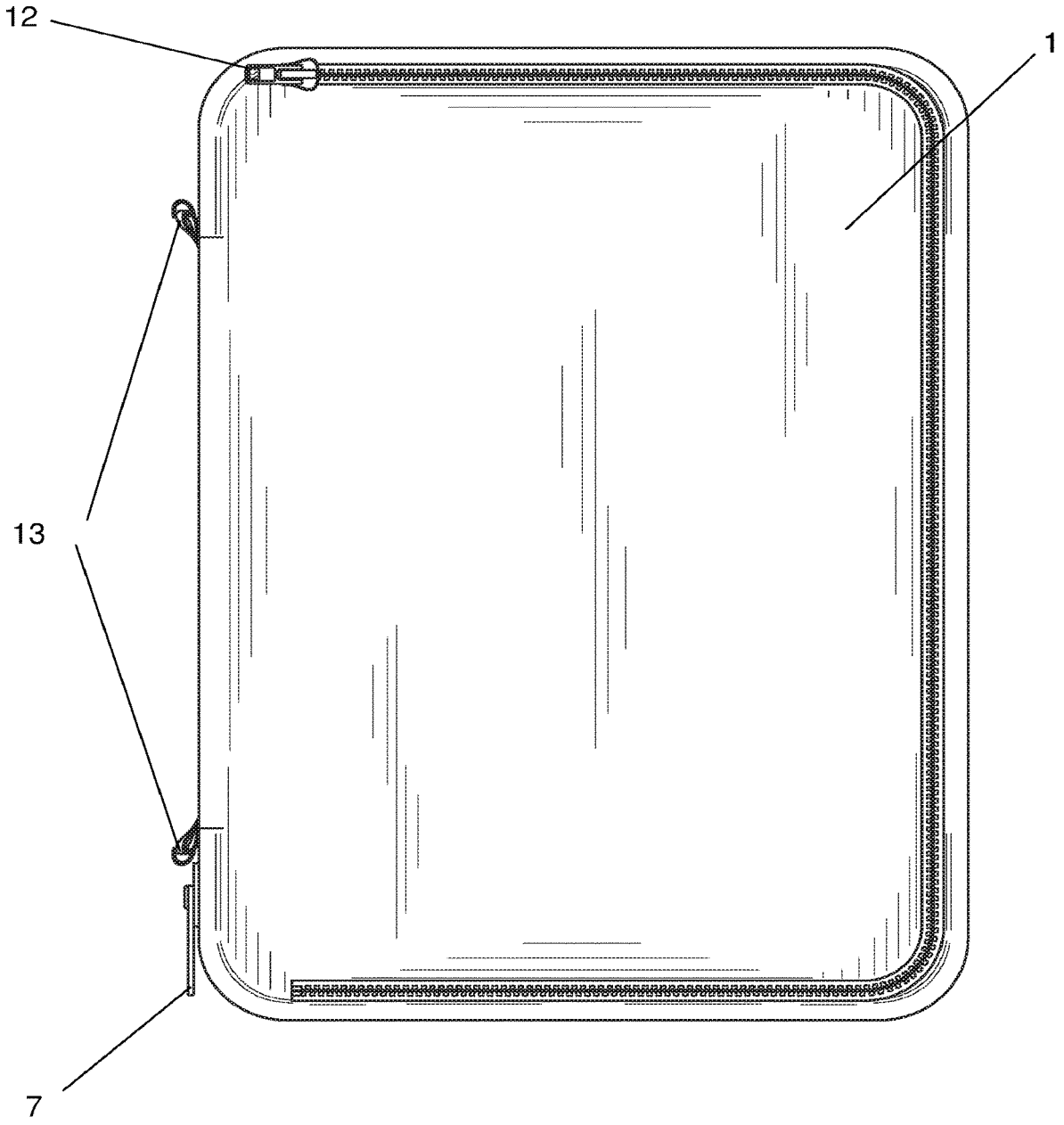
FIG. 1 is the front view of the book enclosure.

The invention is a book enclosure for the storage, transfer and display of decorative pins. The parts of the book enclosure are the front page, translucent cover of the front page, back of the book enclosure, pouch, zipper, interior pages, protective page, the zipper of the translucent cover of the front page, hooks and the removable strap. The border of the book enclosure may be a rectangle, polygon, ellipse, or other shape. One embodiment would have an opaque front page without the translucent cover, utilizing the same material as the rest of the outside of the book, allowing the user only two surfaces for securing pins, Referring to FIG. 1, the translucent cover of the front page 1 would have a translucent, repositionable. protective material which would allow the user to display decorative pins while secured in the book enclosure. On the translucent cover of the front page 1, there is the zipper of the translucent cover of the front page 12 to close and open the translucent cover of the front page 1 after inserting the decorative pins into the front page. The zipper 7 to secure close the book enclosure to keep the interior pages. Also, there are two hooks to attach the removable strap.

Figure 2:
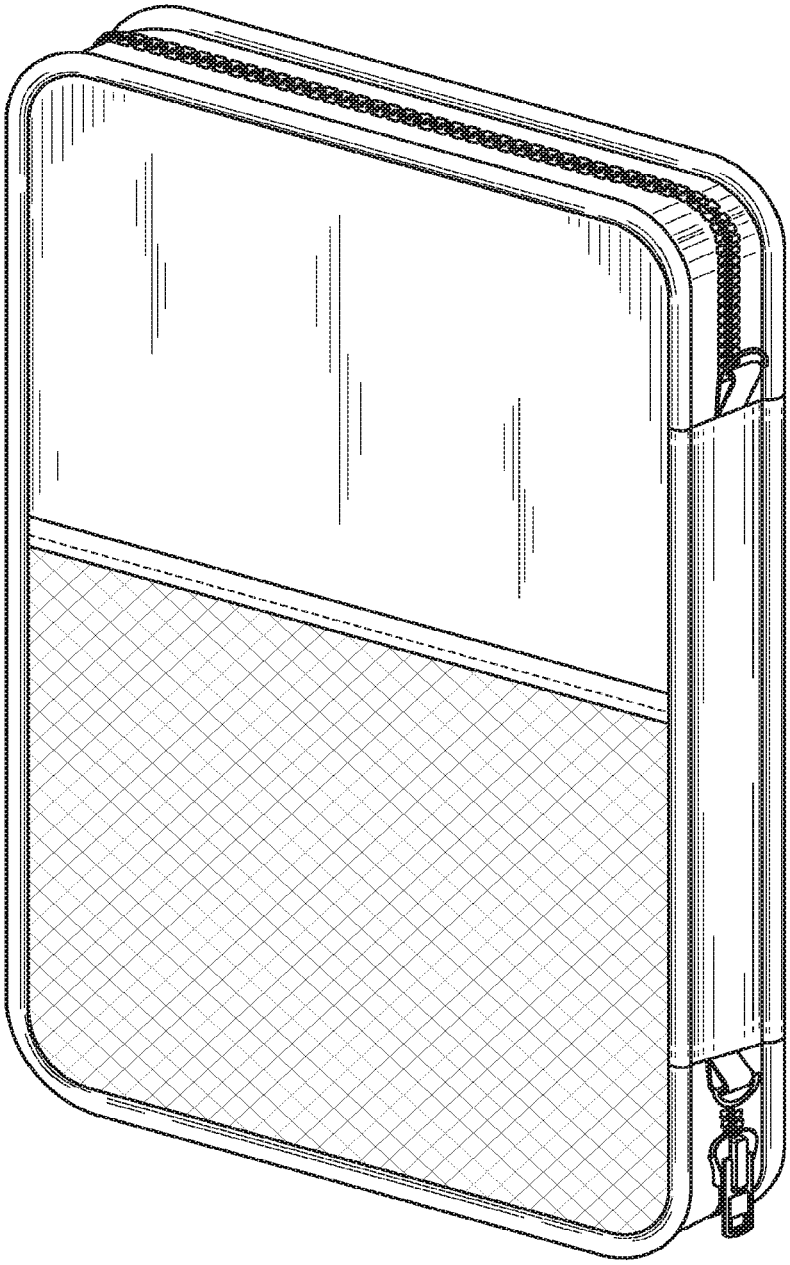
FIG. 2 a perspective view of the book enclosure from the back.
Figure 3:
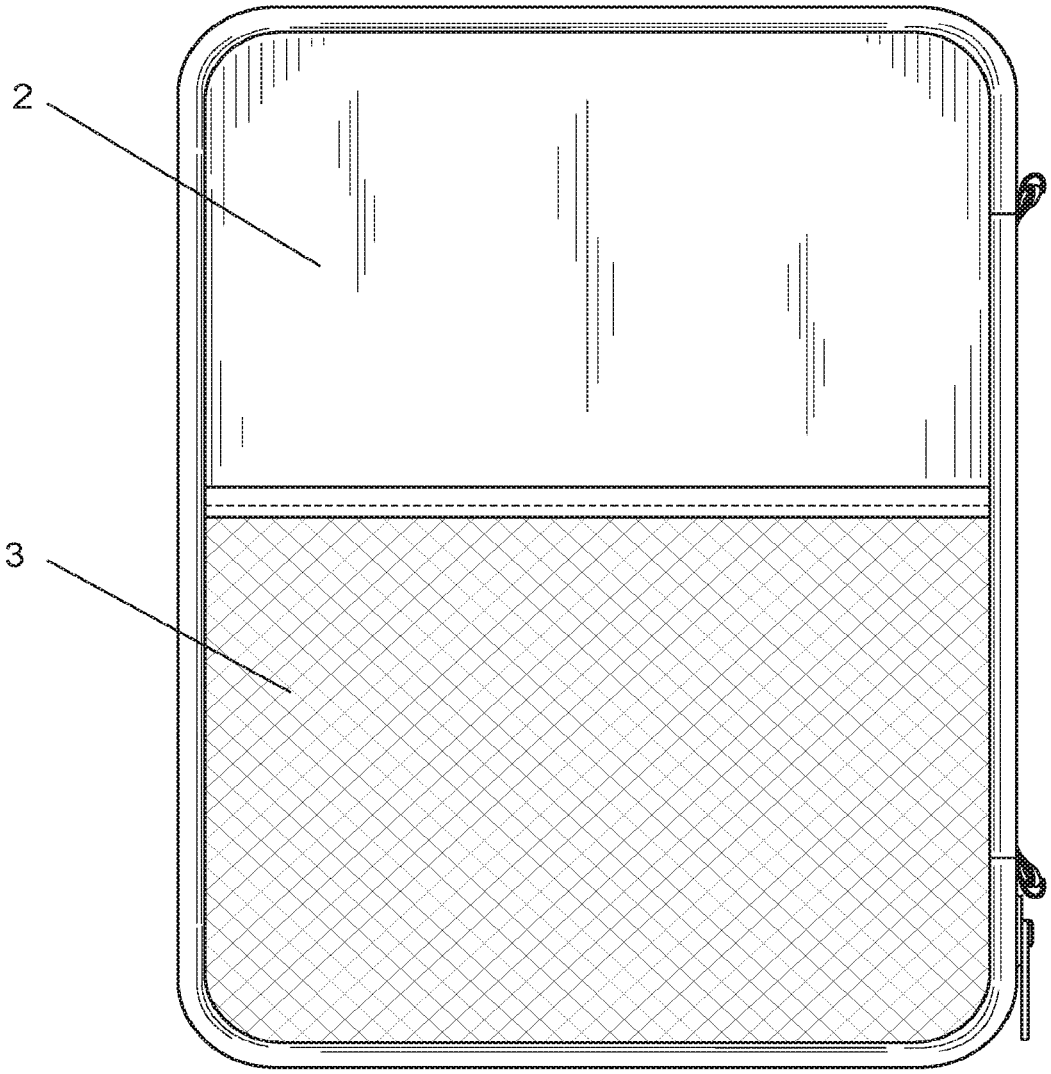
FIG. 3 is the back view of the book.

Referring to FIG. 2, this is a perspective view of the book enclosure from the back. Referring to FIG. 3, this is the back of the book enclosure 2 where there is a pouch 3 for the purposes of storing the decorative pins or other such desired storage.

Figure 4:
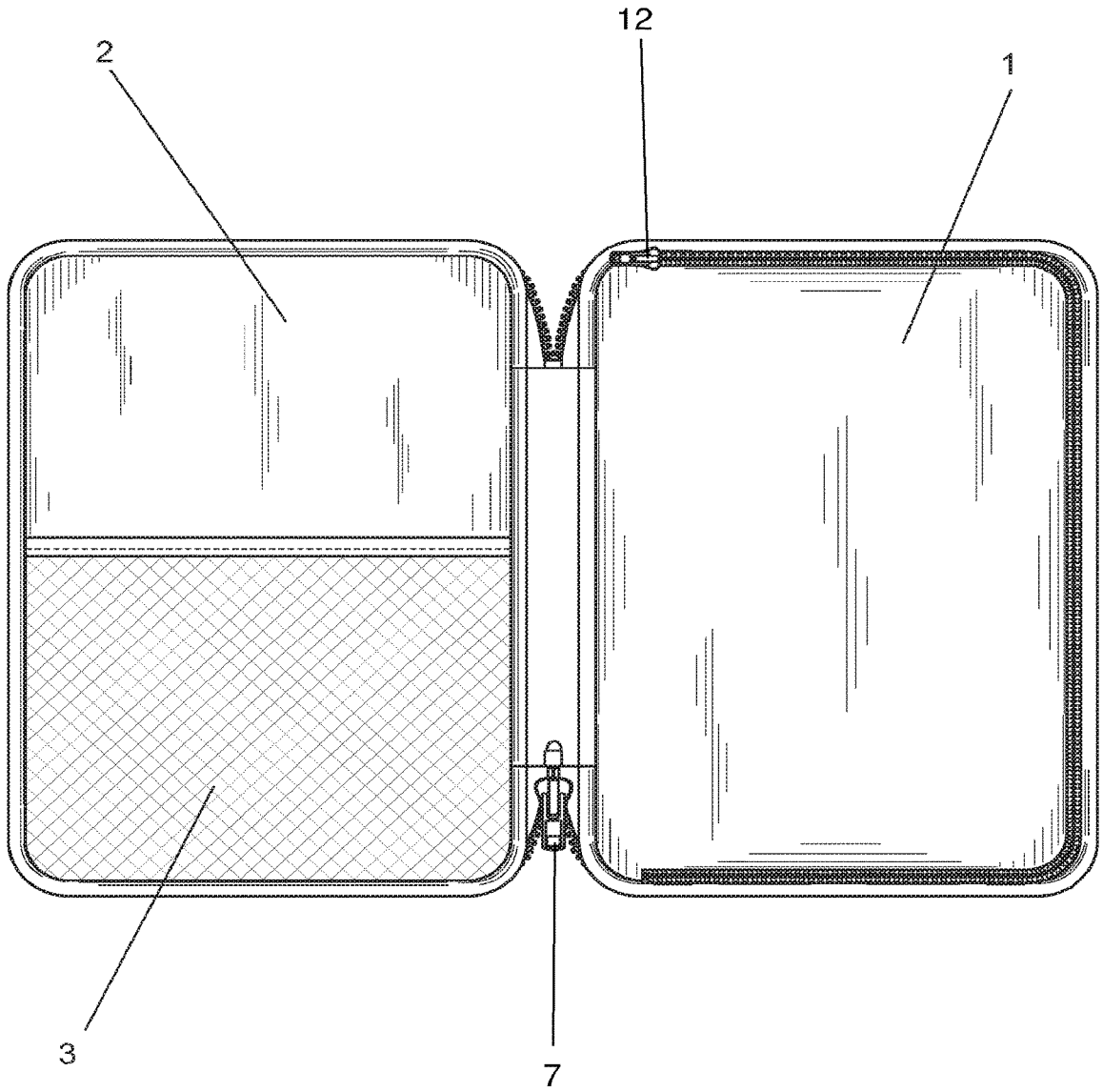
FIG. 4 is the book enclosure in the open position from outside.

Referring to FIG. 4, this is the book enclosure in the open position from the back where both of the translucent cover of the front page 1, the back of the book enclosure 2, pouch 3, the zipper of the translucent cover of the front page 12, and the zipper 7 for the closure of the book appearing.

Figure 5:
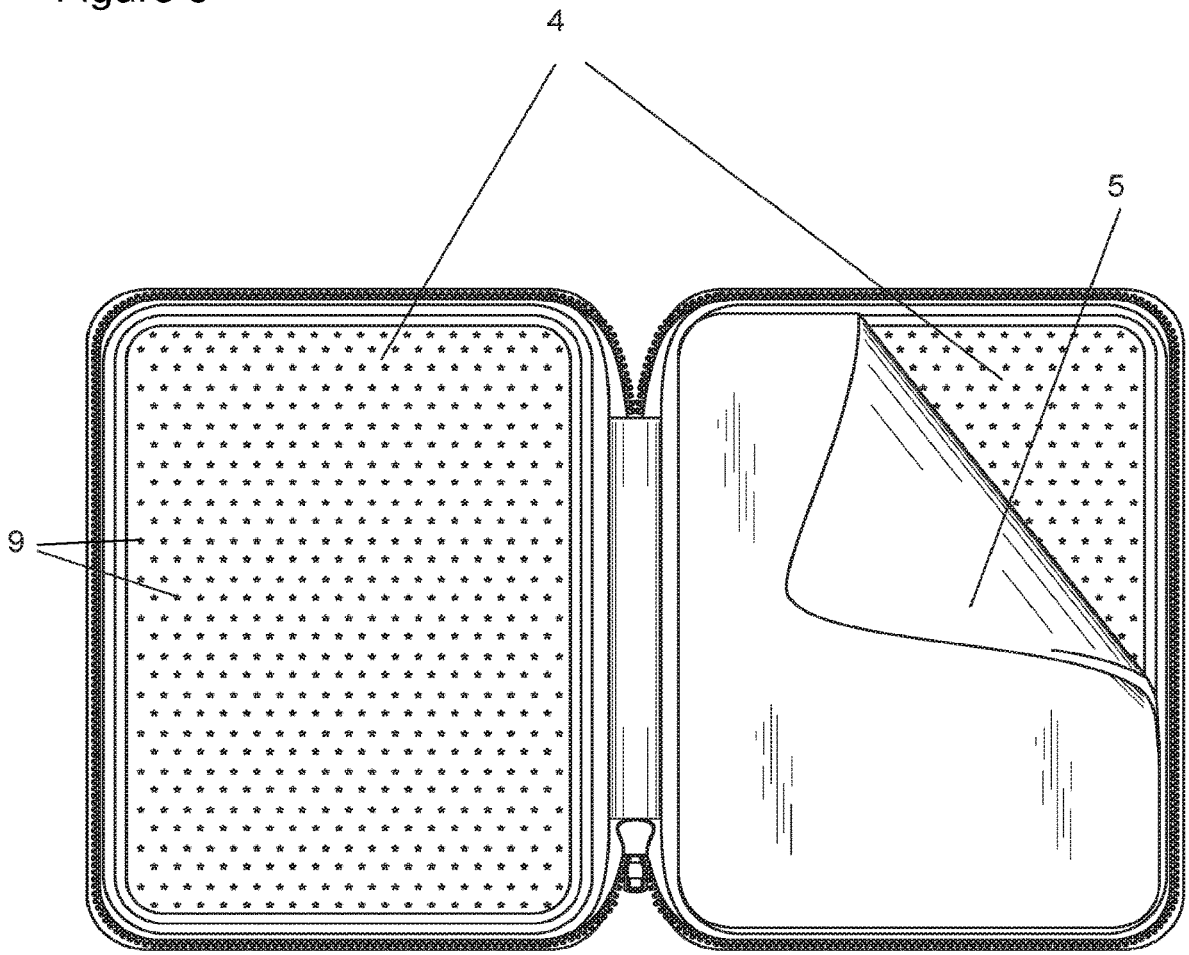
FIG. 5 is the inside view of the book enclosure before inserting the decorative pins.

Referring to FIG. 5, this is inside view of the book enclosure before inserting the decorative pins, there are two interior pages 4, the interior pages 4 are puncturable and resilient consisting of a material for the piercing through of the post(s) portion of a decorative pin(s) and defining a mounting surface for a decorative pin, the insertion of the post portion of the decorative pins. Holes in the star pattern 9 in the interior pages 4 will be result from the insertion of decorative pins after that. Self-healing deformable insert can be made of material such as natural or synthetic rubber or other such synthetic or natural material that can accommodate multiple piercings so that the decorative pins can be changed frequently without affecting the insert's usability. Between the two interior pages 4 there is a protective page 5. The interior pages 4 and the protective page 5 resides inside the book enclosure conforming and compatible with the interior shape of the book enclosure.

Figure 6:
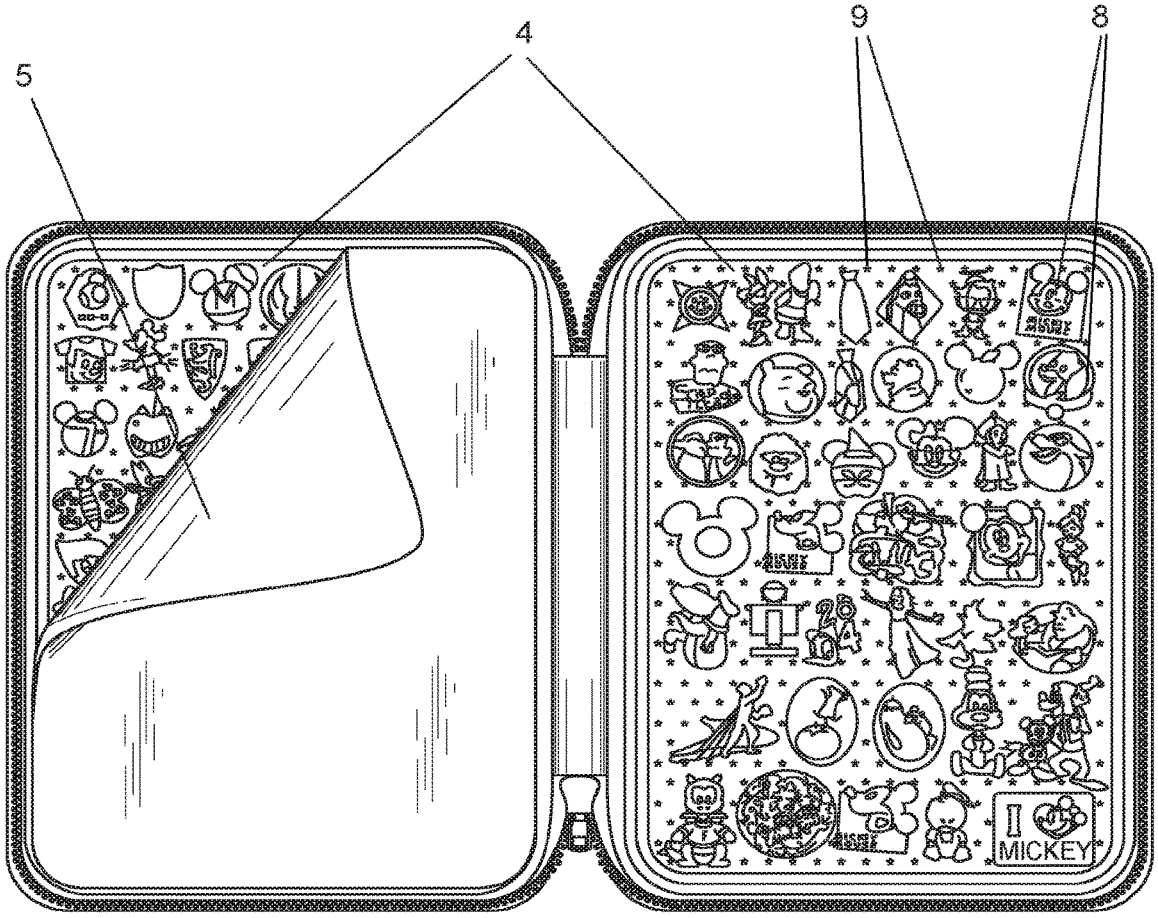
FIG. 6 is the inside view of the book enclosure after inserting the decorative pins into the interior pages

Referring to FIG. 6, this is inside view of the book enclosure after inserting the decorative pins 8 into the two interior pages 4. Inside the interior pages 4 there are pressed, molded holes in the star pattern 9 or other such patterning, or in another embodiment, no pattern whatsoever resulting from the insertion of decorative pins 8, or still in another embodiment, the page may be covered in material. It is possible that a clear cover may be attached to every interior page 4 after the insertion of the decorative pins 8 to give more protection for the decorative pins 8. The protective page 5 between the two interior pages 4 to prevent decorative pins 8 from contact that may be causing a potential damage.

Figure 7:
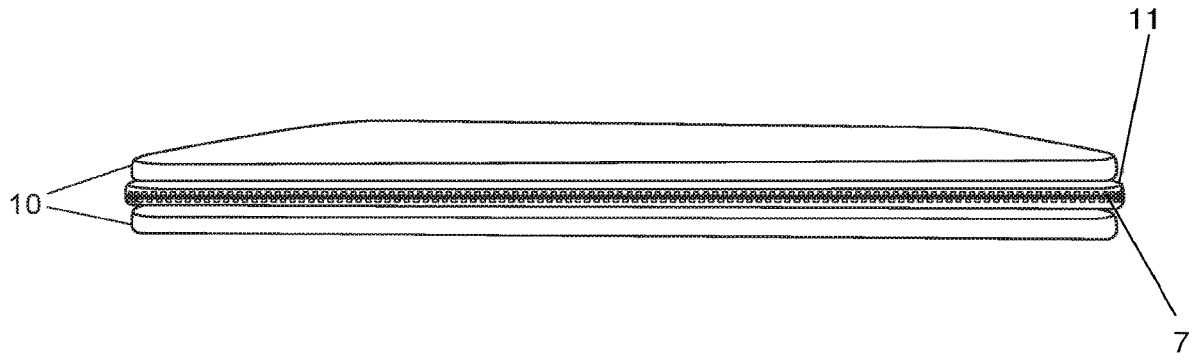
FIG. 7 is a side view of the book enclosure that include two pages.

Referring to FIG. 7, this is the side view of the book enclosure that includes two interior pages only to show the body of book from the outside consisting of external partitions 10 and middle partition 11, the external partitions 10 for the book enclosure that including two interior pages only are two partitions, every external partition 10 for one interior page, and the middle partition 11 will be in any book enclosure whatever the number of interior pages to contain the protective page, on the middle partition 11 there is the zipper 7 to close and open the book enclosure.

Figure 8:
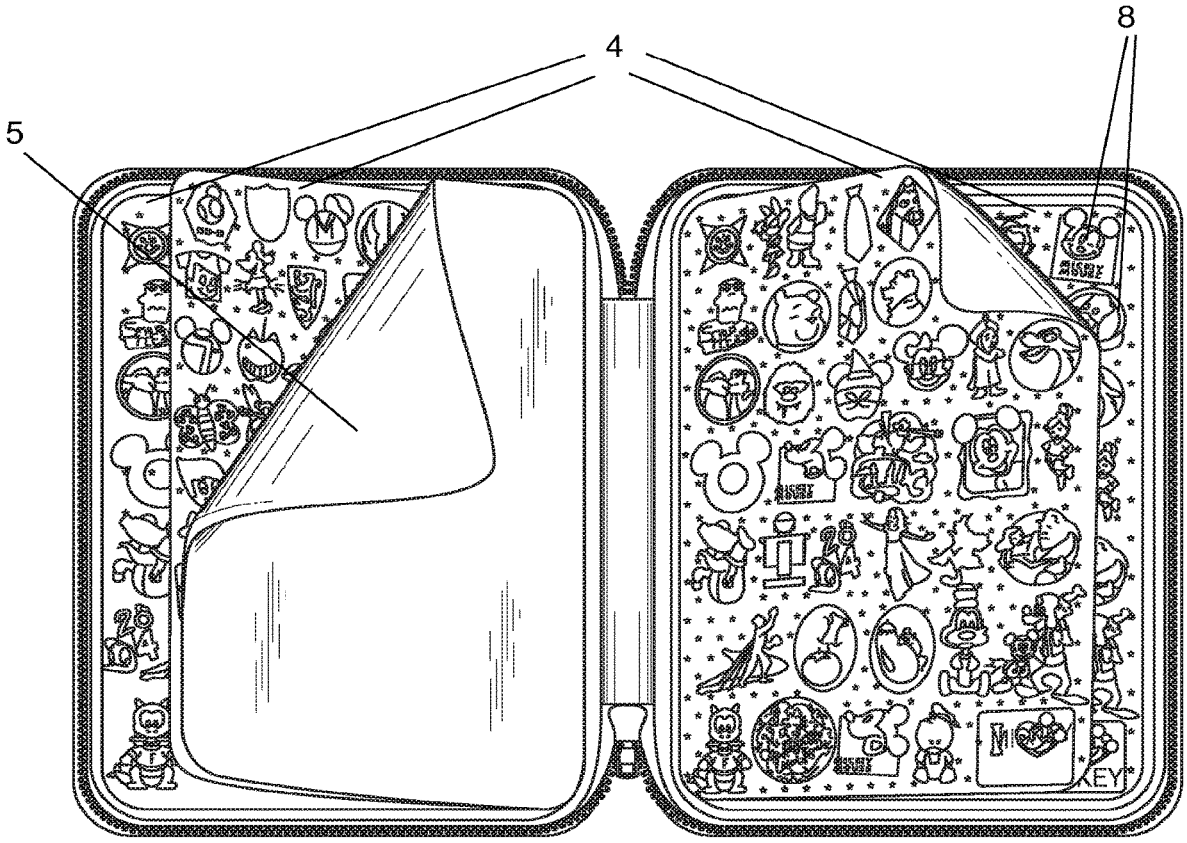
FIG. 8 is the inside view of the book enclosure including more than two interior pages (four interior pages).

Referring to FIG. 8, this is the inside view of the book enclosure including more than two interior pages 4, the book enclosure can be designed with more than two interior pages 4 to insert more decorative pins 8, as example, the book enclosure can be designed with four interior pages 4, also the same protective page 5 is exist to prevent decorative pins 8 from contact that may be causing a potential damage.

Figure 9:
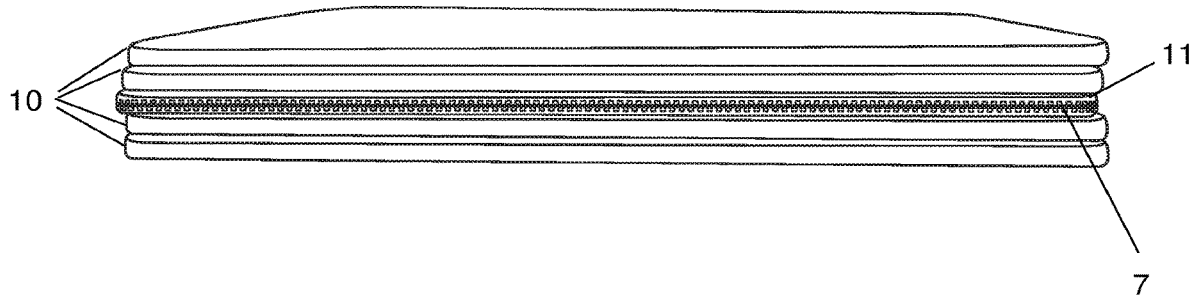
FIG. 9 is a side view of the book enclosure that include four pages.

Referring to FIG. 9, this is the side view of the book enclosure that include four interior pages to show that the body of book from outside consisting of four external partitions 10 and middle partition 11, the external partitions 10 for the book enclosure that including four interior pages are four external partitions 10, every external partition 10 for one interior page, and the middle partition 11 will be in any book enclosure whatever the number of interior pages to contain the protective page, on the middle partition 11 there is the zipper 7 to close and open the book enclosure.

Figure 10:
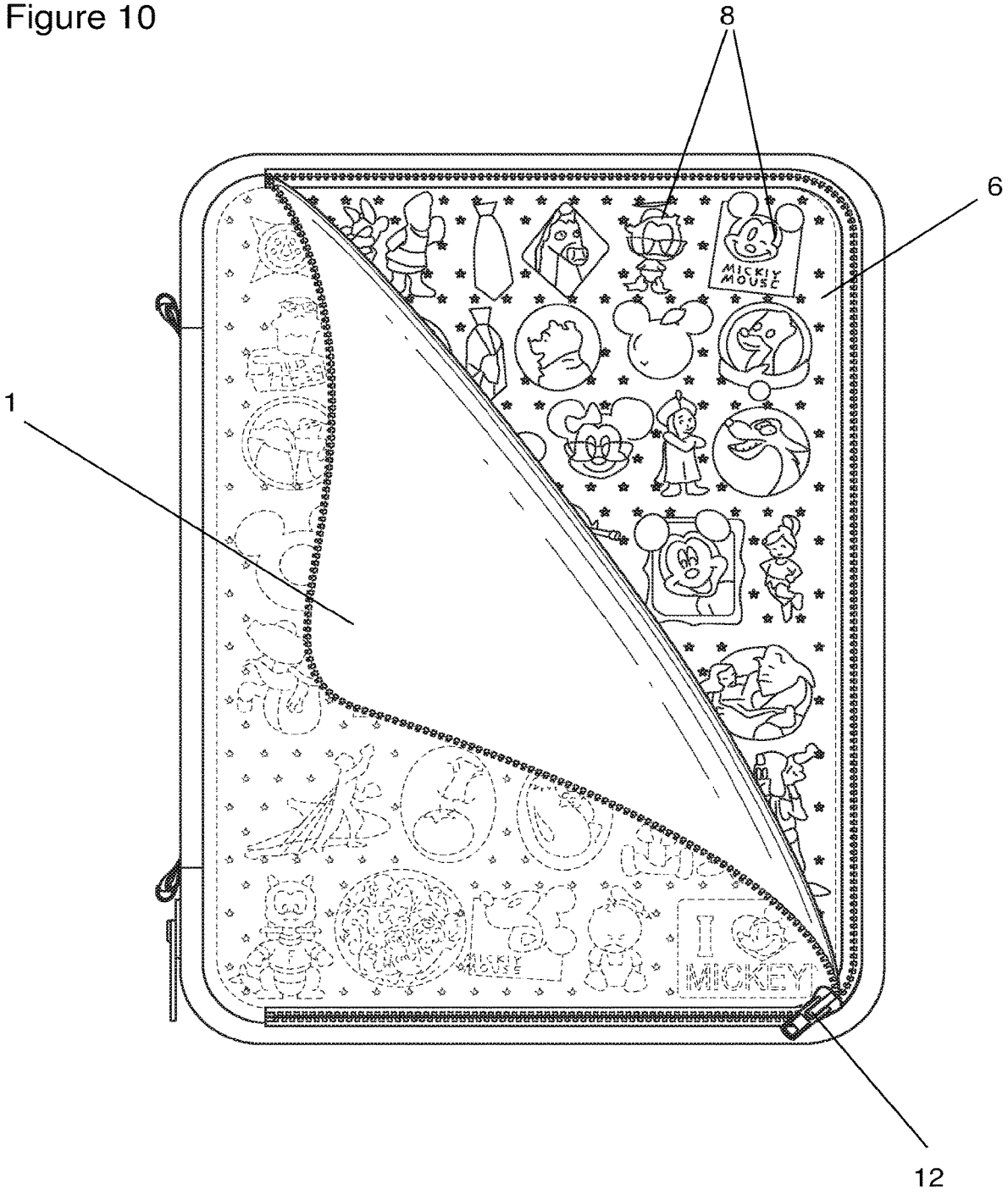
FIG. 10 is the translucent cover of the front page where the zipper of the translucent cover of the front page is open to insert the decorative pins into the front page

Referring to FIG. 10 this is the translucent cover of the front page 1 where the zipper of the translucent cover of the front page 12 is open to insert the decorative pins 8 into the front page 6.

Figure 11:
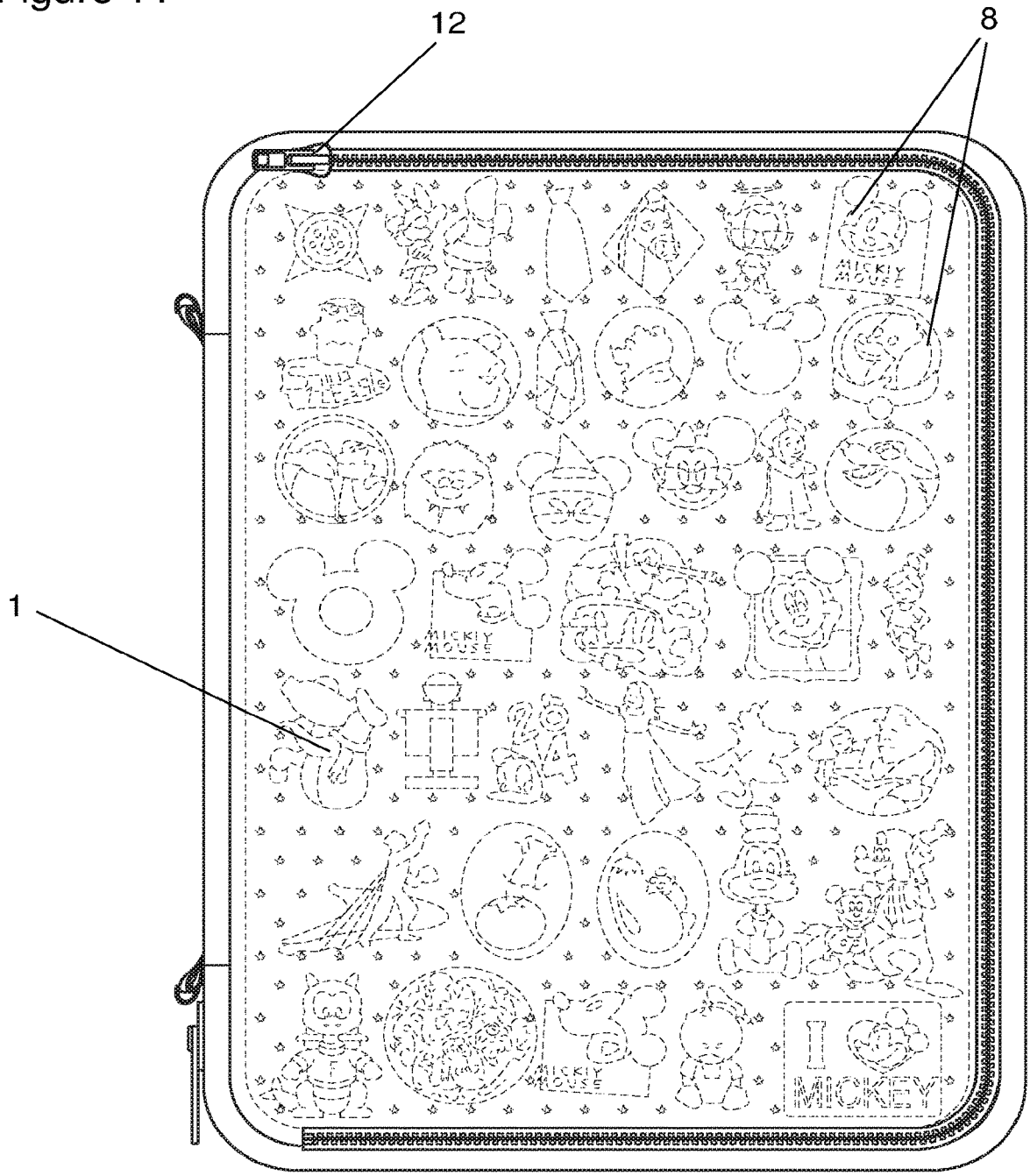
FIG. 11 is the translucent cover of the front page after inserting the decorative pins into the front page then closed the zipper of the translucent cover of the front page.

Referring to FIG. 11 this is the translucent cover of the front page 1 after inserting the decorative pins 8 into the front page then closed the zipper of the translucent cover of the front page 12.

Figure 12:
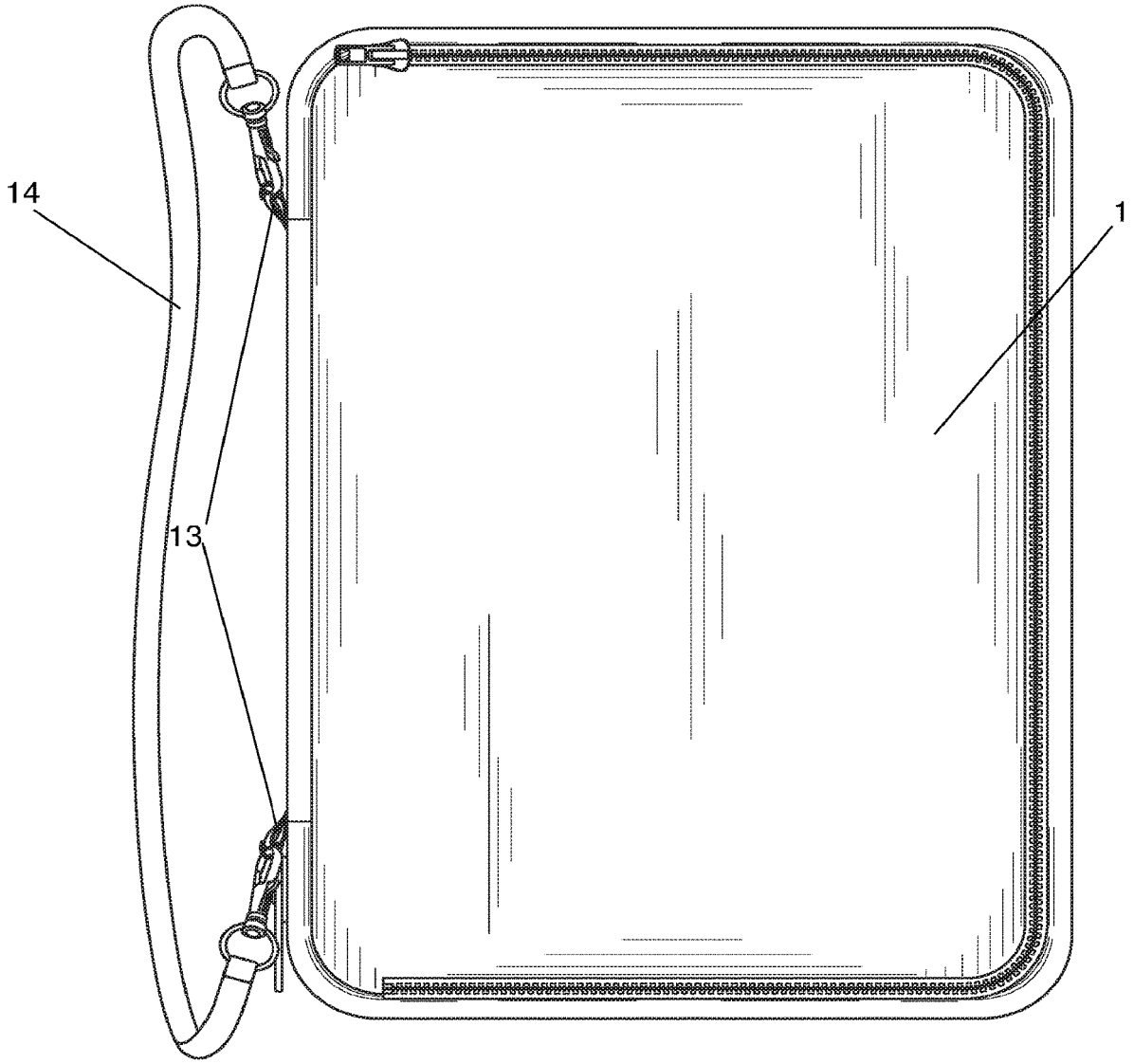
FIG. 12 is the front view of the book enclosure after attached the removable strap.

Referring to FIG. 12, this is the translucent cover of the front page 1 after attached the removable strap 14 to the hooks 13 for the carriage purposes.

What is claimed is:

1. A pin holder for pin trading, comprising:

(a) an enclosure having a front, a back, and a sidewall extending between the front and the back, the enclosure defining an interior space containing a puncturable and resilient material defining a mounting surface for the mounting of pins having post portions, the puncturable and resilient material being configured to receive pin post portions therein for securely retaining pins; and (b) a first closure mechanism disposed in the sidewall of the enclosure, the first closure mechanism extending around a periphery of the enclosure from a first end of a spine portion of the enclosure to a second end of the spine portion of the enclosure, the first closure mechanism being configured to enable opening and closing of the enclosure in the manner of a book, the mounting surface within the interior space being accessible when the enclosure is open for (i) mounting a pin to the mounting surface without using a pin back by pushing the pin onto the mounting surface such that a post portion of the pin pierces and passes into the puncturable and resilient material defining the mounting surface, and (ii) removing a mounted pin from the mounting surface by pulling the mounted pin to effect withdrawal of a pin post portion of the mounted pin from the puncturable and resilient material defining the mounting surface;

(c) wherein the front of the enclosure comprises (i) a cover, (ii) a second mounting surface defined by a puncturable and resilient material for the mounting of pins having post portions, the puncturable and resilient material being configured to receive pin post portions therein for securely retaining pins, and (iii) a second closure mechanism extending along a periphery of the front of the enclosure, the second closure mechanism partially defining a periphery of the cover on three sides, the cover being configured to enable opening and closing of the cover in the manner of a page of a book with the portion of the periphery of the cover that the second closure mechanism does not define serving to maintain securement of the cover to the front of the enclosure during hinged movement of the cover between (A) a closed configuration in which the cover is secured over the second mounting surface, and (B) an open configuration in which the second mounting surface is accessible for (I) mounting another pin to the second mounting surface without using a pin back by pushing the another pin onto the second mounting surface such that a post portion of the another pin pierces and passes into the puncturable and resilient material defining the second mounting surface, and (II) removing another mounted pin from the second mounting surface by pulling the another mounted pin to effect withdrawal of a pin post portion of the another mounted pin from the puncturable and resilient material defining the second mounting surface;

(d) wherein the cover and the second closure mechanism partially defining a periphery of the cover on three sides are positioned and dimensioned such that the second closure mechanism allows access to substantially the entire second mounting surface by folding the cover away from the second mounting surface.

2. The pin holder for pin trading of claim 1, further comprising pins mounted to the first and second mounting surfaces.

3. The pin holder for pin trading of claim 1, wherein the cover is transparent, whereby pins mounted to the second mounting surface may be showcased even when the second closure mechanism is in the closed configuration with the cover secured over the second mounting surface.

4. The pin holder for pin trading of claim 1, wherein an interior page comprises the puncturable and resilient material defining the mounting surface within the interior space.

5. The pin holder for pin trading of claim 1, wherein an insert comprises the puncturable and resilient material defining the second mounting surface of the front of the enclosure.

6. The pin holder for pin trading of claim 5, wherein the front and cover enclose the insert when the second closure mechanism is in the closed configuration.

7. The pin holder for pin trading of claim 1, wherein the first and second closure mechanisms each comprises a zipper.

8. The pin holder for pin trading of claim 1, wherein the puncturable and resilient material defining each mounting surface comprises rubber.

9. The pin holder for pin trading of claim 1, further comprising a strap for cross-body or shoulder portage of the enclosure.

10. The pin holder for pin trading of claim 1, wherein the pin holder further comprises a pouch enclosure for storage of pin backs.

11. A method of using a pin holder for pin trading, (I) the pin holder comprising (a) an enclosure having a front, a back, and a sidewall extending between the front and the back, the enclosure defining an interior space containing a puncturable and resilient material defining a mounting surface for the mounting of pins having post portions, the puncturable and resilient material being configured to receive pin post portions therein for securely retaining pins; and (b) a first closure mechanism disposed in the sidewall of the enclosure, the first closure mechanism extending around a periphery of the enclosure from a first end of a spine portion of the enclosure to a second end of the spine portion of the enclosure, the first closure mechanism being configured to enable opening and closing of the enclosure in the manner of a book, the mounting surface within the interior space being accessible when the enclosure is open for (i) mounting a pin to the mounting surface without using a pin back by pushing the pin onto the mounting surface such that a post portion of the pin pierces and passes into the puncturable and resilient material defining the mounting surface, and (ii) removing a mounted pin from the mounting surface by pulling the mounted pin to effect withdrawal of a pin post portion of the mounted pin from the puncturable and resilient material defining the mounting surface;

(c) wherein the front of the enclosure comprises (i) a cover, (ii) a second mounting surface defined by a puncturable and resilient material for the mounting of pins having post portions, the puncturable and resilient material being configured to receive pin post portions therein for securely retaining pins, and (iii) a second closure mechanism extending along a periphery of the front of the enclosure, the second closure mechanism partially defining a periphery of the cover on three sides, the cover being configured to enable opening and closing of the cover in the manner of a page of a book with the portion of the periphery of the cover that the second closure mechanism does not define serving to maintain securement of the cover to the front of the enclosure during hinged movement of the cover between (A) a closed configuration in which the cover is secured over the second mounting surface, and (B) an open configuration in which the second mounting surface is accessible for (I) mounting another pin to the second mounting surface without using a pin back by pushing the another pin onto the second mounting surface such that a post portion of the another pin pierces and passes into the puncturable and resilient material defining the second mounting surface, and (II) removing another mounted pin from the second mounting surface by pulling the another mounted pin to effect withdrawal of a pin post portion of the another mounted pin from the puncturable and resilient material defining the second mounting surface;

(d) wherein the cover and the second closure mechanism partially defining a periphery of the cover on three sides are positioned and dimensioned such that the second closure mechanism allows access to substantially the entire second mounting surface by folding the cover away from the second mounting surface; and (II) the method comprising (a) opening the enclosure to access the mounting surface contained within the interior space;

(b) removing a first pin from the mounting surface by pulling the first pin to effect withdrawal of a pin post portion of the first pin from the puncturable and resilient material defining the mounting surface; and (c) mounting a second pin to the mounting surface without using a pin back by pushing the second pin onto the mounting surface such that a post portion of the second pin pierces and passes into the puncturable and resilient material defining the mounting surface;

(d) transitioning the second closure mechanism to an open configuration;

(e) removing a third pin from the second mounting surface by pulling the third pin to effect withdrawal of a pin post portion of the third pin from the second mounting surface;

(f) mounting a fourth pin to the second mounting surface without using a pin back by pushing the fourth pin onto the second mounting surface such that a post portion of the pin pierces and passes into the second mounting surface; and (g) transitioning the second closure mechanism to a closed configuration such that the cover is secured over the second mounting surface.

12. The method of using a pin holder in accordance with claim 11, wherein the cover is transparent whereby pins mounted to the second mounting surface are showcased even when the second closure mechanism is transitioned to the closed configuration.

13. The method of using a pin holder in accordance with claim 11, wherein an insert comprising a puncturable and resilient material defines the second mounting surface, the method further comprising positioning the insert between the cover and the front of the enclosure.

14. The method of using a pin holder in accordance with claim 11, wherein the pin holder further comprises a pouch enclosure for storage of pin backs, the method further comprising storing in the pouch enclosure pin backs for the pins that are mounted to the mounting surface.

15. The method of using a pin holder in accordance with claim 11, wherein the pin holder further comprises a strap, the method further comprising carrying the pin holder using the strap by positioning the strap on one's shoulder.

16. The method of using a pin holder in accordance with claim 11, wherein the pin holder further comprises a strap, the method further comprising carrying the pin holder using the strap by positioning the strap across one's body.

17. The method of using a pin holder in accordance with claim 11, wherein the closure mechanism comprises a zipper.

18. The method of using a pin holder in accordance with claim 11, wherein the second closure mechanism comprises a zipper.

19. The method of using a pin holder in accordance with claim claim 11, wherein a page comprising a-puncturable and resilient material defines the mounting surface, the page being attached to the enclosure, the method further comprising detaching and removing the page from the enclosure.

* * * * *